US006348931B1

(12) United States Patent
Suga et al.

(10) Patent No.: US 6,348,931 B1
(45) Date of Patent: Feb. 19, 2002

(54) DISPLAY CONTROL DEVICE

(75) Inventors: Kazumi Suga, Yokohama; Masayuki Sawada, Machida, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/090,335

(22) Filed: Jun. 4, 1998

(30) Foreign Application Priority Data

Jun. 10, 1997 (JP) ..... 9-152038
Jun. 20, 1997 (JP) ..... 9-163909

(51) Int. Cl.[7] ..... G09G 5/02

(52) U.S. Cl. ..... 345/699; 345/3.4; 345/698; 345/3.3

(58) Field of Search ..... 345/99, 204, 132, 345/127, 698, 699, 3.3, 3.4; 348/552; 395/102

(56) References Cited

U.S. PATENT DOCUMENTS 5,031,118 A * 7/1991 Morizot ..... 345/132
5,406,308 A * 4/1995 Shiki ..... 345/127
5,592,194 A * 1/1997 Nishikawa ..... 345/127
5,633,655 A * 5/1997 Hara ..... 345/132
5,654,738 A * 8/1997 Spurlock ..... 345/132
5,889,927 A * 3/1999 Suzuki ..... 395/102
5,929,924 A * 7/1999 Chen ..... 348/552
6,037,925 A * 3/2000 Kim ..... 345/99
6,078,317 A * 6/2000 Sawada ..... 345/204

* cited by examiner

*Primary Examiner*—Steven Saras
*Assistant Examiner*—Uchendu O. Anyaso
(74) *Attorney, Agent, or Firm*—Fitzpatrick, Cella, Harper & Scinto

(57) ABSTRACT

A display control device detects the state of an input video signal, sets the display mode of a display device among n predetermined display modes corresponding to different states of the input video signal on the basis of the detection output, and controls the display operation of the display device in accordance with the set mode. When the detected state of the input video signal does not match any of the n predetermined display modes, the display mode of the display device is set to be one of the n predetermined display modes.

30 Claims, 13 Drawing Sheets

FIG. 4

T

| DISPLAY MODE | HORIZONTAL AND VERTICAL RESOLUTION | HORIZONTAL SYNC SIGNAL FREQUENCY (KHz) | VERTICAL SYNC SIGNAL FREQUENCY (Hz) | VERTICAL SYNC SIGNAL POLARITY |
|---|---|---|---|---|
| 01 | 600pixel × 400pixel | $31.47_a$ | $70.09_b$ | POSITIVE |
| 02 | | 37.86 | 85.08 | POSITIVE |
| 03 | | 24.83 | 56.43 | NEGATIVE |
| 04 | 640pixel × 480pixel | 31.47 | 59.94 | NEGATIVE |
| 05 | | 37.81 | 72.81 | NEGATIVE |
| 06 | | $39.38_c$ | $75.00_d$ | POSITIVE |
| 07 | | $37.50_{c'}$ | $75.00_d$ | NEGATIVE |
| 08 | | 35.00 | 66.70 | POSITIVE |
| 09 | 800pixel × 600pixel | 35.16 | 56.25 | POSITIVE |
| 0a | | 37.88 | 60.32 | POSITIVE |
| 0b | | 48.08 | 72.19 | POSITIVE |
| 0c | | 46.88 | 75.00 | POSITIVE |
| 0d | 832pixel × 624pixel | 49.70 | 75.00 | POSITIVE |
| 0e | 1024pixel × 768pixel | 48.36 | 60.00 | NEGATIVE |
| 0f | | 56.48 | 70.07 | NEGATIVE |
| 10 | | 61.08 | 78.78 | POSITIVE |
| 11 | | 60.02 | 75.03 | POSITIVE |
| 12 | | 60.24 | 75.10 | NEGATIVE |
| 13 | 1152pixel × 870pixel | 68.70 | 75.00 | POSITIVE |
| 14 | 1280pixel × 1024pixel | 64.30 | 60.10 | POSITIVE |
| 15 | | 79.98 | 75.03 | POSITIVE |
| 16 | | 78.00 | 72.00 | POSITIVE |
| 17 | | 78.00 | 74.00 | POSITIVE |

DISPLAY CONTROL DEVICE

BACKGROUND OF THE INVENTION

1. Field of the Invention

The present invention relates to a display control device and, more particularly, to switching of display modes.

2. Related Background Art

Conventionally, as display devices for host computer apparatuses such as personal computers (to be referred to as PCs hereinafter), workstations, and the like, raster-scan type so-called CRTs (Cathode-Ray Tubes) display devices are popularly used.

In recent years, flat-panel display devices such as liquid crystal panels, plasma displays, and the like are receiving a lot of attention in terms of space savings, energy savings, ergonomics, and the like.

The signal exchanged between the above-mentioned display device and host computer apparatus is a so-called video signal, i.e., a combined signal of an analog image signal and horizontal and vertical sync signals, or a composite signal thereof.

The video signal sent to the display device has a very large number of specifications (standards) depending on host computer apparatuses.

Especially, when a PC is used as the host computer apparatus, there are a plurality of different resolutions as those for the image to be displayed. For example, the following horizontal resolutions× vertical resolutions are available: 320×200 pixels, 640×400 pixels, 720×400 pixels, 640×350 pixels, 640×480 pixels, 800×600 pixels, 832×642 pixels 1,024×768 pixels, 1,152×870 pixels, 1,280×1,024 pixels, and the like.

Furthermore, even at identical resolution, there are a plurality of modes (display modes) using different horizontal and vertical sync signal frequencies. This is because the video signal sent to the display device has different standards depending on PCs, and has various resolutions, as described above. In this fashion, since the scan speed (scan frequency) per second varies depending on the resolutions and standards, the display mode must be selected to display images corresponding to various types of video signals mentioned above using an identical display device.

For this purpose, a display device having a function of automatically selecting the display mode (multiscan function) has been proposed.

This display device is a so-called multiscan display device. In such display device, a plurality of display modes corresponding to a plurality of different combinations of the sync signal frequencies and their polarity signals of the input video signals (input signals) are prepared, and the display parameters of these display modes are pre-stored in a ROM (Read Only Memory) or the like. The display device measures the sync signal frequency and its polarity signals of an actually input video signal, and acquires the display parameters of the display mode corresponding to the detected combination of the signals. Using these parameters, the display device measures the display resolution, horizontal and vertical blanking periods, and the like of the input signals, and makes predetermined setups.

However, when the above-mentioned multiscan display device does not store any display parameters of a display mode corresponding to the actually measured sync signal frequency and its polarity signal of the input signal, an image cannot be displayed satisfactorily. For example, no image can be displayed on the screen.

On the other hand, recently, PCs are popularly used in applications such as CAD (Computer Aided Design) and the like that require graphics display. Accordingly, the graphics display of computer displays is required to have high image quality. In order to satisfy such requirement, the following methods are available:

1. increase the display resolution
2. raise the frame (field) frequency

The former method can obtain a finer image, and the latter method allows a flicker-free display. For this reason, it is becoming a common practice for PCs to use displays which have SVGA display modes with resolutions as high as 800×600, 1,024×768, and 1,280×1024, in addition to the conventionally popular VGA mode with a resolution of 640×480. Furthermore, the vertical sync frequency tends to rise from 60 Hz to more than 70 Hz.

The video signal output from a workstation or PC is displayed on a high-resolution FLCD (Ferroelectric Liquid Crystal Display) as the above-mentioned flat-panel display as follows. That is, as described above, the display mode is identified from the sync signal sent from the computer, and the sync signal is separated into horizontal and vertical sync signals. Based on the identified display mode, FLCD dot clocks synchronous with the pixel clocks of the computer are reproduced using the separated horizontal sync signal, and an image signal is A/D-converted using the FLCD dot clocks. The obtained digital data is subjected to $\gamma$ characteristic adjustment and halftone processing, and that digital image data is transferred to an FLCD output controller, thus attaining a display.

In the display modes such as VGA, SVGA, XGA, and the like with lower resolutions, an enlarged interpolation display is made based on the identified display mode to display an image on the entire screen, by "oversampling" the horizontal effective display region of the video signal to 1,280 pixels that match the number of display line pixels of the FLCD as for expansion in the line direction, and performing a digital interpolation that maintains the aspect ratio as for expansion in the vertical direction.

However, when the video signal sent from the computer is displayed on the FLCD in an enlarged scale by interpolation on the basis of the above-mentioned oversampling, the following problem is posed. That is, since the analog video signal is sampled asynchronously to the pixel clocks of the host computer, a transient, sharply changing point is sampled between neighboring pixels. In this case, the dot clocks as the sampling clocks for A/D conversion are generated based on the horizontal sync signal, which normally includes jitter. Under the influences of such jitter, the dot clocks also unwontedly jitter. For this reason, mainly in case of a still image, the sampling points vary between neighboring pixels in units of frames, resulting in image quality deterioration such as flickering.

SUMMARY OF THE INVENTION

It is an object of the present invention to solve the above-mentioned problems.

It is another object of the present invention to satisfactorily display an image independently of the state of the input signal.

In order to solve the above problems and to achieve the above objects, according to one aspect of the present invention, there is provided a display control device for controlling a display device which displays an image corresponding to an input video signal, comprising detection means for detecting a state of the input video signal, mode setting means for setting a display mode of the display device among n different display modes corresponding to different states of the input video signal on the basis of an output from the detection means, and control means for controlling display operation of the display device in accordance with the display mode set by the mode setting means, wherein the mode setting means setting the display mode of the display device to be one of the n different display modes when the state of the input video signal detected by the detection means does not match any of the n different display modes.

It is still another object of the present invention to obtain a high-quality, interpolated image free from flickering.

Other objects and features of the present invention will become apparent from the following detailed description of the embodiments of the present invention taken in conjunction with the accompanying drawings.

BRIEF DESCRIPTION OF THE DRAWINGS

FIG. 4 is a table for explaining different display modes;

DETAILED DESCRIPTION OF THE PREFERRED EMBODIMENTS

The preferred embodiments of the present invention will be described hereinafter.

Figure 1:
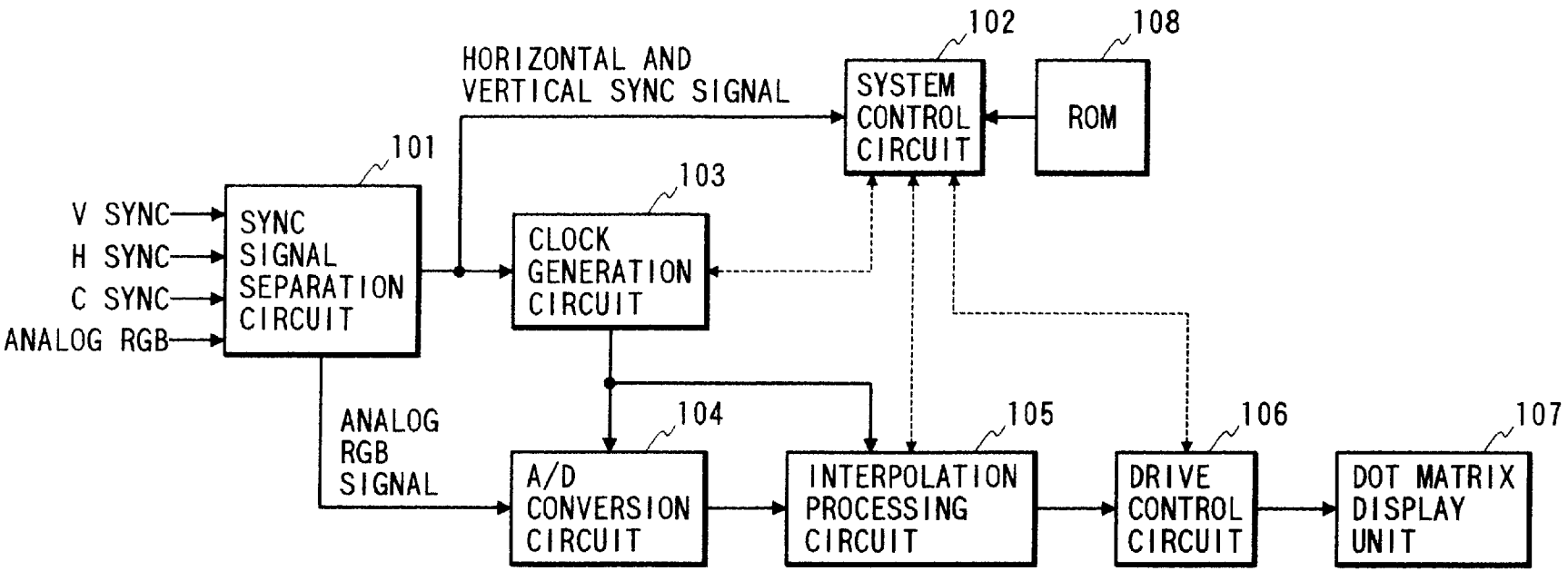
FIG. 1 is a block diagram showing the arrangement of a display control device according to an embodiment of the present invention.

FIG. 1 is a block diagram showing the arrangement of a display control device 100 to which the present invention is applied.

The display control device 100 controls display of a dot matrix display unit 107 having the above-mentioned multi-scan function, and comprises a sync signal separation circuit 101 which receives a video signal from a host computer apparatus (not shown), a system control circuit 102, clock generation circuit 103, and analog/digital (A/D) conversion circuit 104, which receive the outputs from the sync signal separation circuit 101, an interpolation processing circuit 106 which receives the output from the A/D conversion circuit 104, a drive control circuit 105 which receives the output from the interpolation processing circuit 105, and a ROM 108 accessed by the system control circuit 102. The output from the clock generation circuit 103 is supplied to the A/D conversion circuit 104, and the output from the drive control circuit 106 is supplied to the dot matrix display unit 107.

The display control device 100 receives a video signal from the host computer apparatus. The video signal includes an analog multi-valued image signal (to be referred to as an RGB signal or simply as an image signal hereinafter) and sync signals such as composite sync, separate sync, sync-on-green, or the like.

The sync signal separation circuit 101 separates the image and sync signals from the input video signal.

The sync signal separation circuit 101 generates negative horizontal and vertical sync signals, and sync signal polarity signal from the separated sync signal, and supplies these signals to the system control circuit 102 and clock generation circuit 103. Also, the circuit 101 supplies the separated image signal to the A/D conversion circuit 104.

The clock generation circuit 103 generates sampling clocks used in the A/D conversion circuit 104 on the basis of the horizontal and vertical sync signals and sync signal polarity signal supplied from the sync signal separation circuit 101 under the control of the system control circuit 102 (to be described later).

The A/D conversion circuit 104 converts the image signal supplied from the sync signal separation circuit 101 into digital data in accordance with the sampling clocks generated by the clock generation circuit 103, and supplies it as image data to the interpolation processing circuit 105.

The system control circuit 102 measures the frequencies of the horizontal and vertical sync signals and the polarity of the vertical sync signal in the input video signal using the horizontal and vertical sync signals and sync signal polarity signal supplied from the sync signal separation circuit 101, and discriminates the display mode of the input video signal on the basis of the measurement result.

Figure 2:
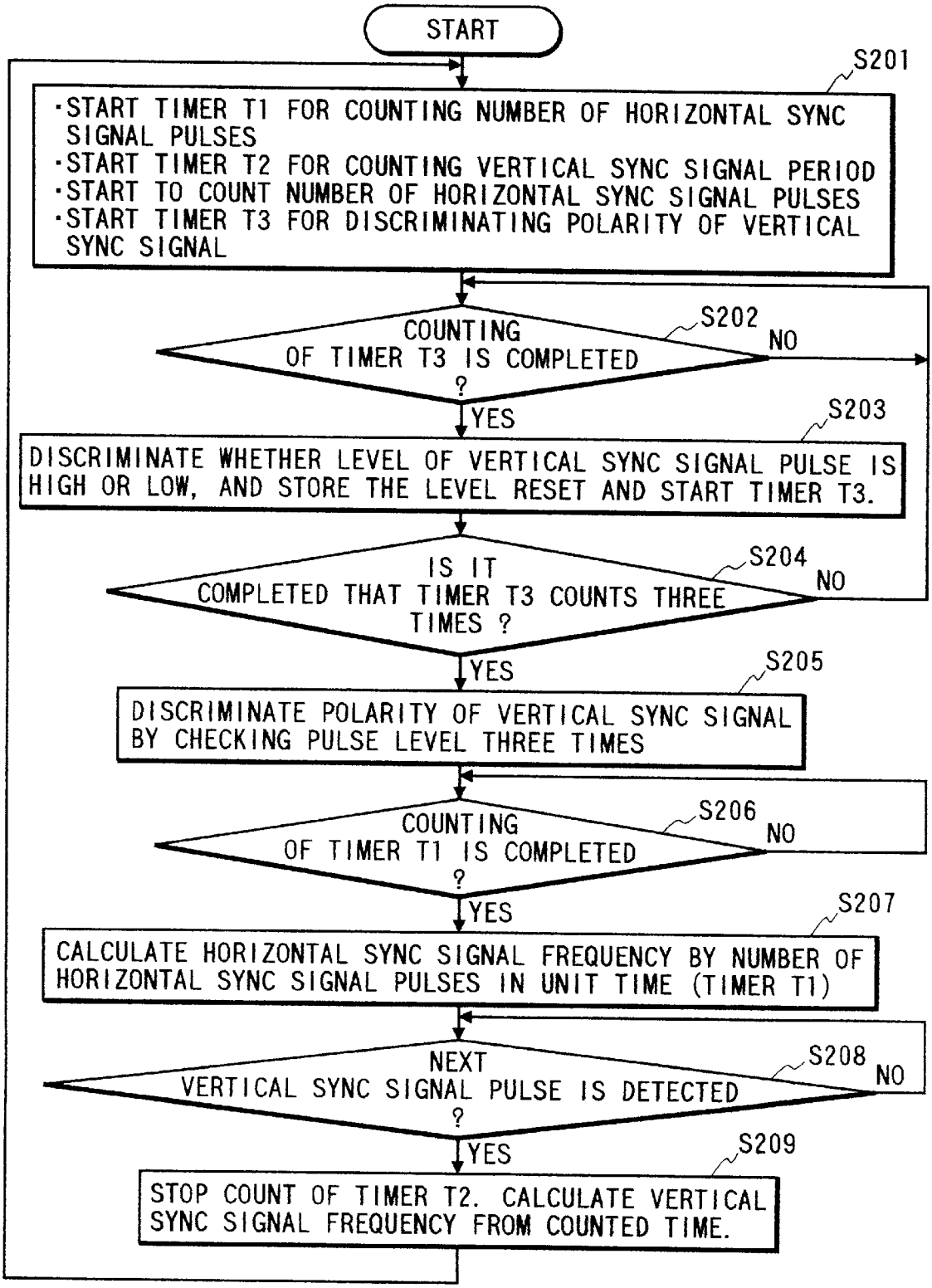
FIG. 2 is a flow chart for explaining the frequency measurement of a sync signal.

Note that the ROM 108 pre-stores a processing program according to the flow chart shown in, e.g., FIG. 2.

The system control circuit 102 reads out and executes the processing program in FIG. 2 stored in the ROM 108, thus measuring the frequencies of the horizontal and vertical sync signals and the polarity of the vertical sync signal.

The measurement done by the system control circuit 102 will be described in detail below with reference to FIGS. 2 and 3.

Figure 3:
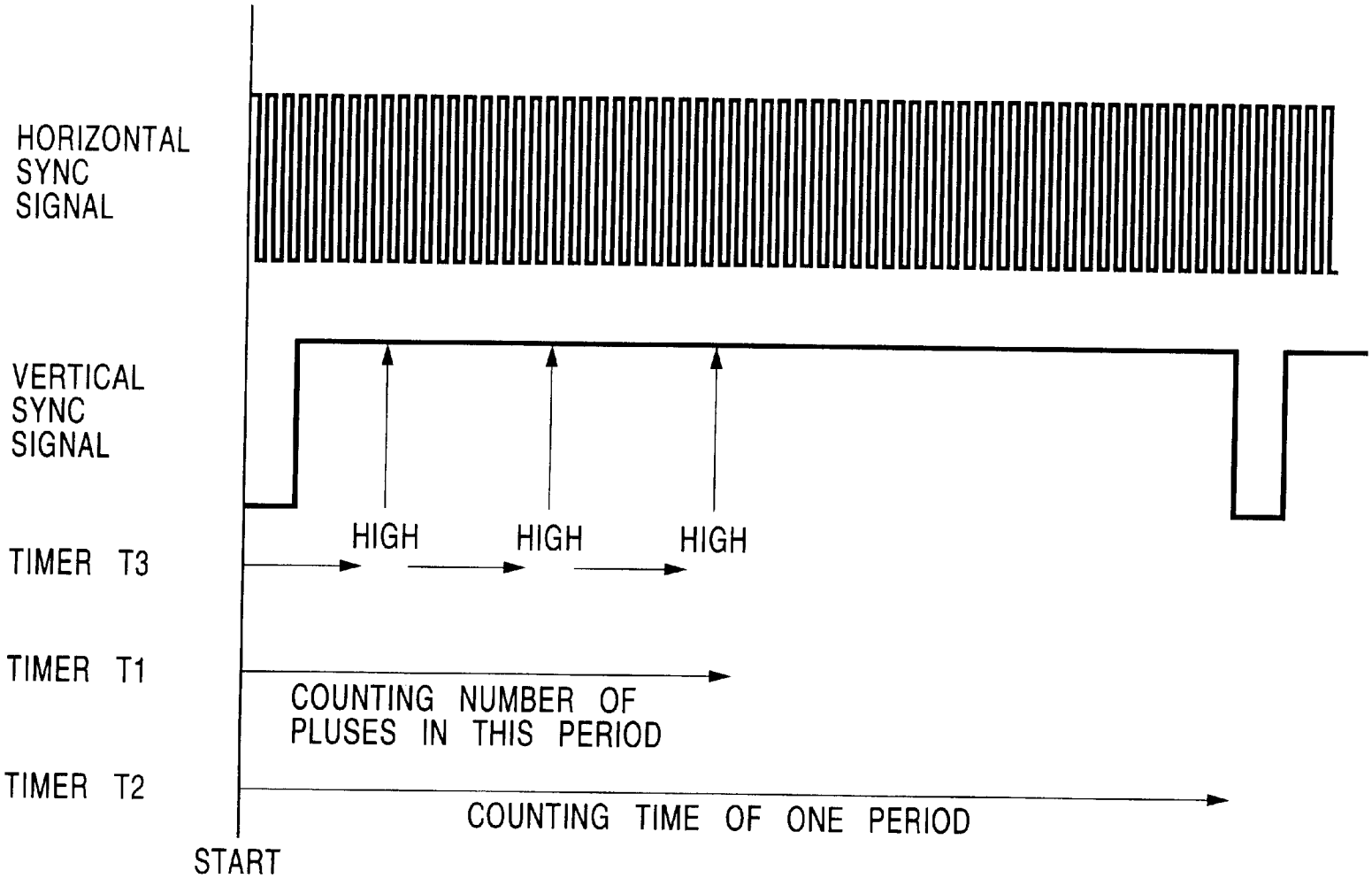
FIG. 3 is a chart for explaining the frequency measurement shown in FIG. 2.

The system control circuit 102 simultaneously starts three internal timers T1, T2, and T3 in accordance with the vertical sync signal supplied from the sync signal separation circuit 101, as shown in FIG. 3. The timer T1 counts the number of horizontal sync signal pulses, and the timer T2 counts the vertical sync signal period. These timers T1 and T2 are respectively set at predetermined periods (10 ms, 20 ms, and the like). The timer T3 is used for discriminating the polarity of the vertical sync signal, and is set at a period longer than the active duration of the vertical sync signal but sufficiently shorter than its one period.

Counting of the number of horizontal sync signal pulses is started (step S201).

Subsequently, it is checked if counting of the timer T3 is completed (step S202). If this checking result indicates "completion of counting", the flow advances to step S203.

In step S203, it is discriminated if the level of the vertical sync signal pulse is high or low, and this discrimination result is temporarily saved in an internal memory (not shown). After that, the timer T3 is restarted (step 8203).

It is discriminated if the timer T3 has completed counting three times (step S204). If this discrimination result does not indicate "completion of counting three times", the flow returns to step S202; otherwise, the flow advances to step S205.

In steps S202 to S204, whether the level of the vertical sync signal pulse is high or low is discriminated at a period (timer T3 period) longer than the active duration of the vertical sync signal but sufficiently shorter than its one period, and this discrimination is repeated three times. As a result, the internal memory saves three discrimination results indicating whether the level of the vertical sync signal pulse is high or low for each timer T3 period.

In step S205, the polarity of the vertical sync signal is discriminated based on the three discrimination results saved in the internal memory. More specifically, if two or more vertical sync signal pulses are high level (HIGH), as shown in FIG. 3, it is discriminated that the polarity of this vertical sync signal is active low.

It is then discriminated if counting of the timer T1 is completed (step S206). If the discrimination result indicates "completion of counting", the flow advances to step S207.

In step S207, the horizontal sync signal frequency is calculated based on the number of horizontal sync signal pulses during the period of the timer T1.

For example, when the timer T1 is set at 10 ms and the number of horizontal sync signal pulses during that period is 500, the horizontal sync signal frequency is 50 kHz.

Subsequently, whether or not the next vertical sync signal pulse is detected is discriminated based on the vertical sync signal from the sync signal separation circuit 101 (step S208). When the discrimination result indicates that "the next vertical sync signal pulse has been detected", the flow advances to step S209.

In step S209, the vertical sync signal frequency is calculated by measuring the time for one period of the vertical sync signal by the timer T2.

For example, when the timer T2 is set at 20 ms, the vertical sync signal frequency is 50 Hz.

In this fashion, the system control circuit 102 obtains the horizontal and vertical sync signal frequencies and the polarity of the vertical sync signal.

The system control circuit 102 then discriminates the display mode corresponding to these results using a table T shown in FIG. 4.

The table T stores the resolutions, horizontal and vertical sync signal frequencies, and polarities of the vertical sync signal corresponding to three different display modes.

Figure 5:
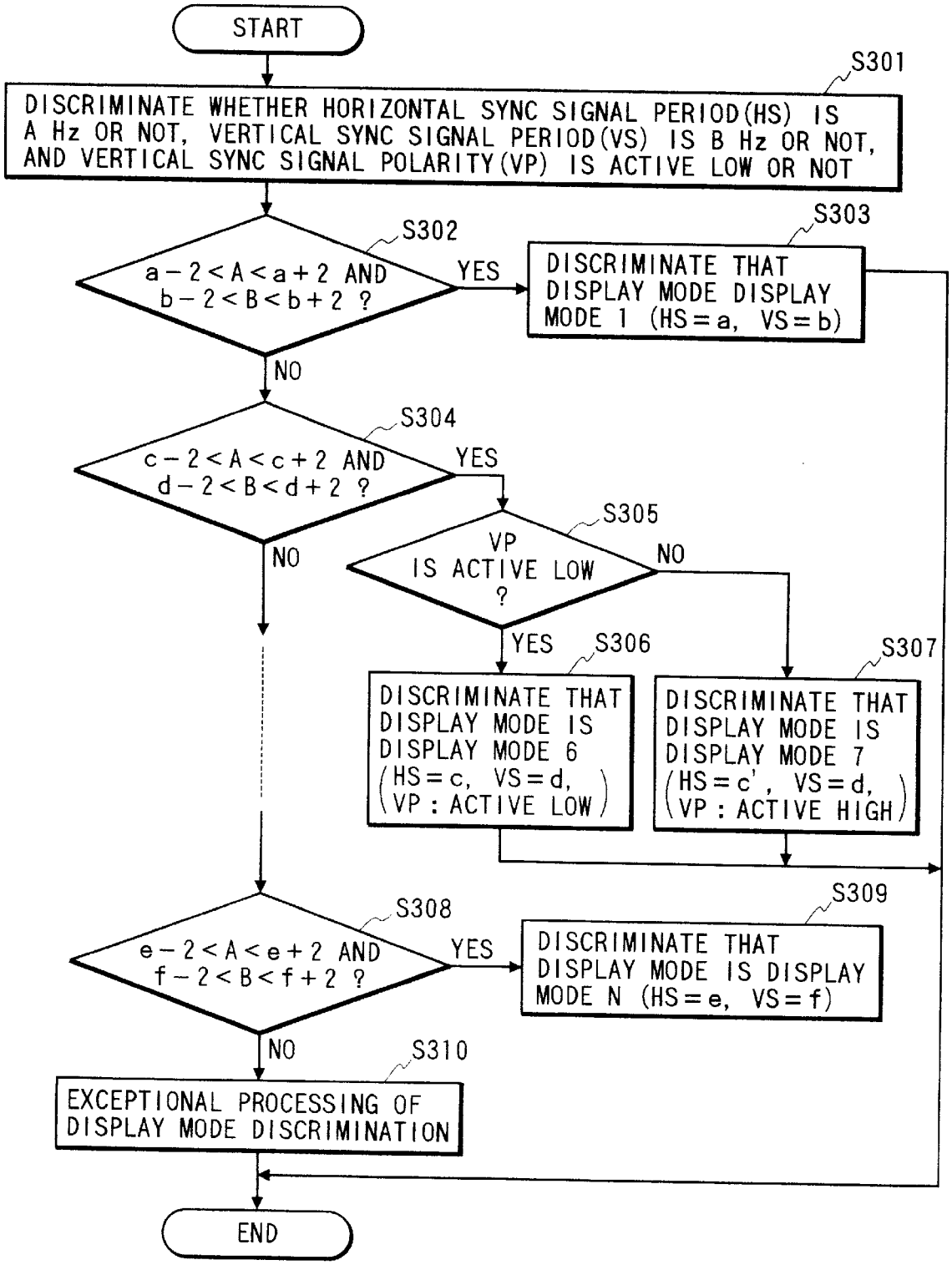
FIG. 5 is a flow chart for explaining display mode discrimination.

The ROM 108 also pre-stores, for example, the table T shown in FIG. 4 and the processing program according to the flow chart shown in FIG. 5.

The system control circuit 102 reads out and executes the processing program in FIG. 5 stored in the ROM 108, thus implementing display mode discrimination.

The discrimination done by the system control circuit 102 will be explained in detail below with reference to FIGS. 4 and 5.

When the obtained horizontal sync signal frequency (horizontal sync signal period; to be referred to as "HD" hereinafter) is A Hz, the vertical sync signal frequency (vertical sync signal period; to be referred to as "VD" hereinafter) is B Hz, and the polarity (to be referred to as "VP" hereinafter) of the vertical sync signal is active low (Low) (step S301), it is checked if these HD and VD values A and B are respectively close to HD and VD values a (=31.47) and b (70.09) of display mode 01 in the table T in FIG. 4 (step S302).

For example, it is checked if the values A and B respectively fall within the ranges from−2 to +2 of the values a and b of display mode 01, i.e., they satisfy conditional formulas 1 below:

$$a-2<A<a+2$$

$$b-2<B<b+2$$

If it is determined in step S302 that the values A and B satisfy conditional formulas 1, the display mode of the input video signal is determined to be display mode 01 (step S303).

On the other hand, if it is determined in step S302 that the values A and B do not satisfy conditional formulas 1, it is checked as in step S302 if the HD and VD values A and B are respectively close to HD and VD values ("37.86" and "85.08") of the next display mode 02. In accordance with this discrimination result, display mode 02 is determined as in step S303 or whether or not the display mode is the next display mode 03 is checked.

In this manner, by discriminating display modes 01, 02, 03, . . . in turn, display mode N of the input video signal is finally determined (steps S308 and S309).

At this time, some display modes have nearly the same HD and VD values but different VP values. For example, in display mode 06, an HD value c is "39.38", a VD value d is "75.00", and VP is "positive", while in display mode 07, an HD value cl is "37.50", a VD value d is "75.00", and VP is "negative".

In such case, if discrimination is made as in step S302, the values A and B satisfy conditional formulas 2 (step S304):

$$c-2<A<c+2$$

$$d-2<B<d+2$$

and also satisfy conditional formulas 3:

$$c'-2<A<c'+2$$

$$d-2<B<d+2$$

As a consequence, it is determined that the display mode is either display mode 06 or 07.

In such case, it is checked if VP is "positive" (active Low) (step S305). If it is determined that VP is "positive", display mode 06 is determined (step S306); if it is determined that VP is not "positive" (VP is "negative"), display mode 07 is determined (step S307).

If no display mode is determined as a result of the processing in step S302 to S309 described above, i.e., none of HD, VD, and VP values of the display modes (display modes 01 to 17 in this embodiment) stored in the table T satisfy the conditions, display mode discrimination exceptional processing is executed (step S310).

The display mode discrimination exceptional processing is done in two stages. In the first stage, the horizontal and vertical resolutions (display resolution) of the input signal are discriminated. In the second stage, of the display modes stored in the table T in FIG. 4, a display mode which has horizontal and vertical sync signal frequencies closest to those of the display resolution discriminated in the first stage is determined.

Figure 6:
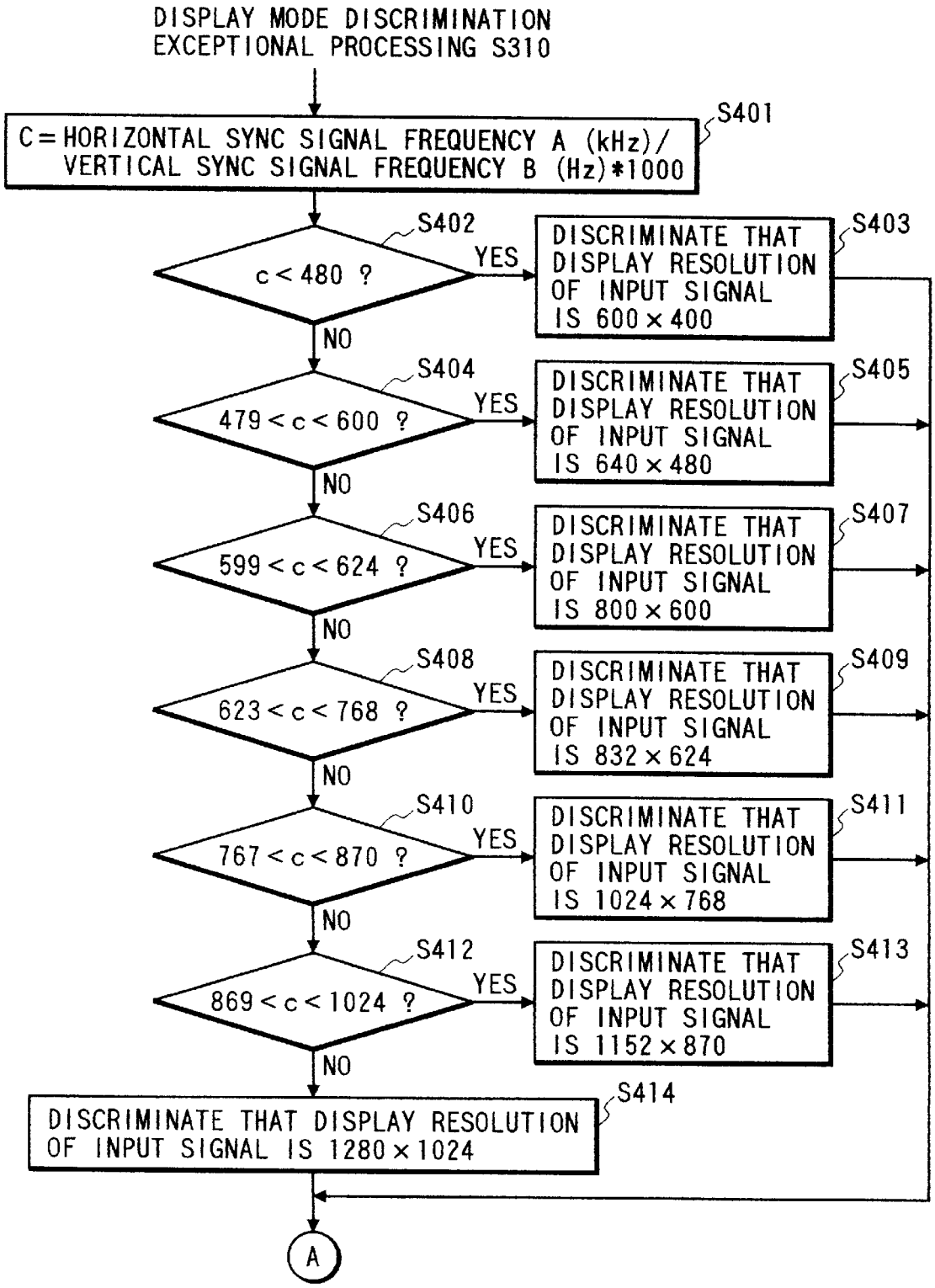
FIG. 6 is a flow chart for explaining the display mode discrimination exceptional processing.
Figure 7:
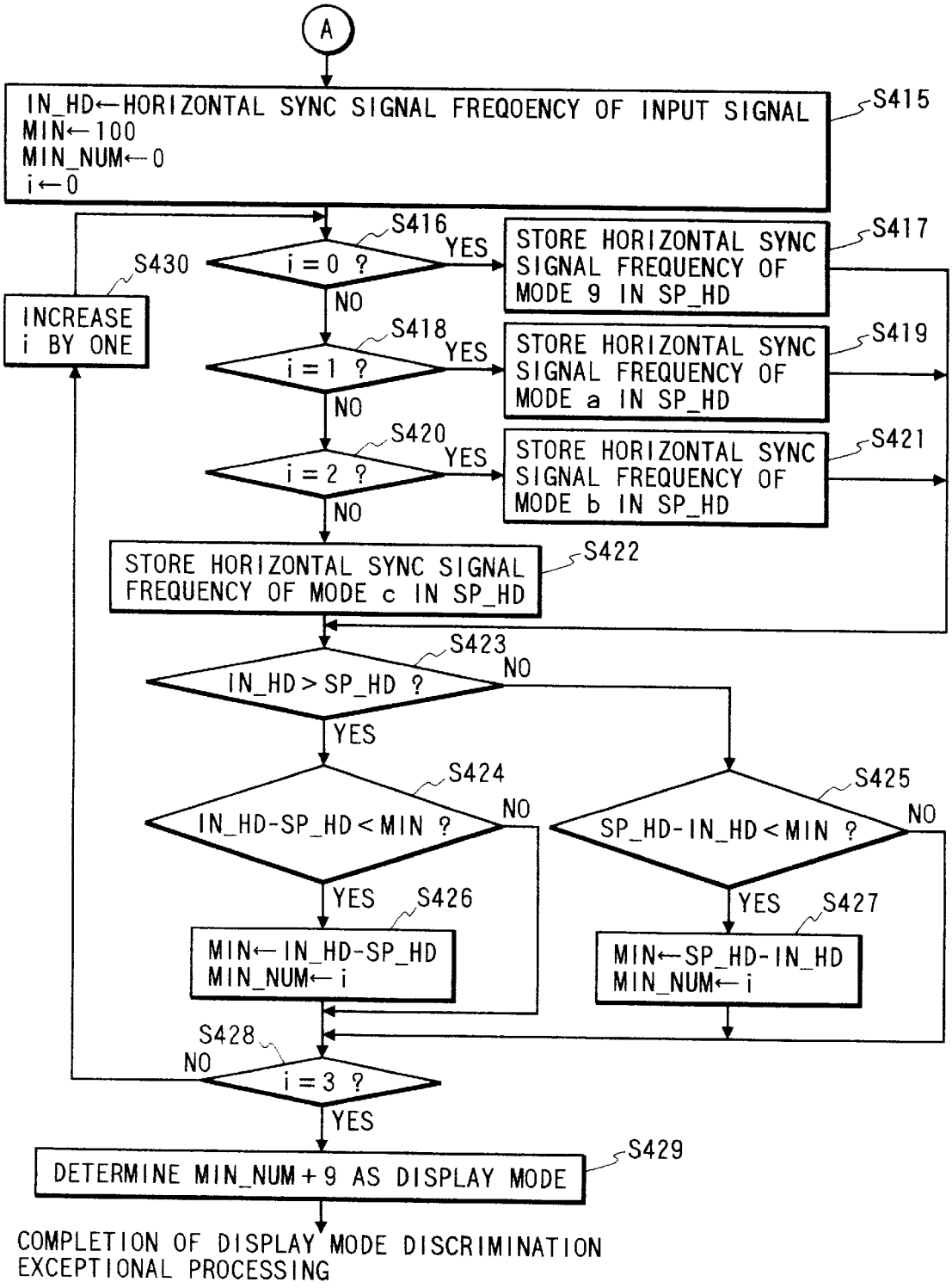
FIG. 7 is a flow chart for explaining the display mode discrimination exceptional processing.

In order to implement the above-mentioned display mode discrimination exceptional processing, for example, the ROM 108 pre-stores the processing program according to the flow charts shown in FIGS. 6 and 7.

The system control circuit 102 reads out and executes the processing program in FIGS. 6 and 7 stored in the ROM 108, thus implementing the display mode discrimination exceptional processing.

The display mode discrimination exceptional processing done by the system control circuit 102 will be described in detail below with reference to FIGS. 6, 7, and 8.

In the processing of the first stage, a value C (=the number of horizontal scan lines during the vertical sync period) obtained by dividing frequency B of the vertical sync signal of the input signal by frequency A of the horizontal sync signal is calculated (step S401).

Using the calculated value C, the vertical resolution of the input signal is discriminated in the subsequent processing steps S402 to S414.

That is, it is checked in turn if the value C calculated in step S401 satisfies "C<480" (step S402), "479<C<600" (step S404), "599<C<624" (step S406), "623<C<768" (step S408), "767<C<870" (step S410), and "869<C<1,024" (step S412).

For example, if the value C is "580", it is determined in step S404 that the vertical resolution of this input signal is "480".

Figure 8:
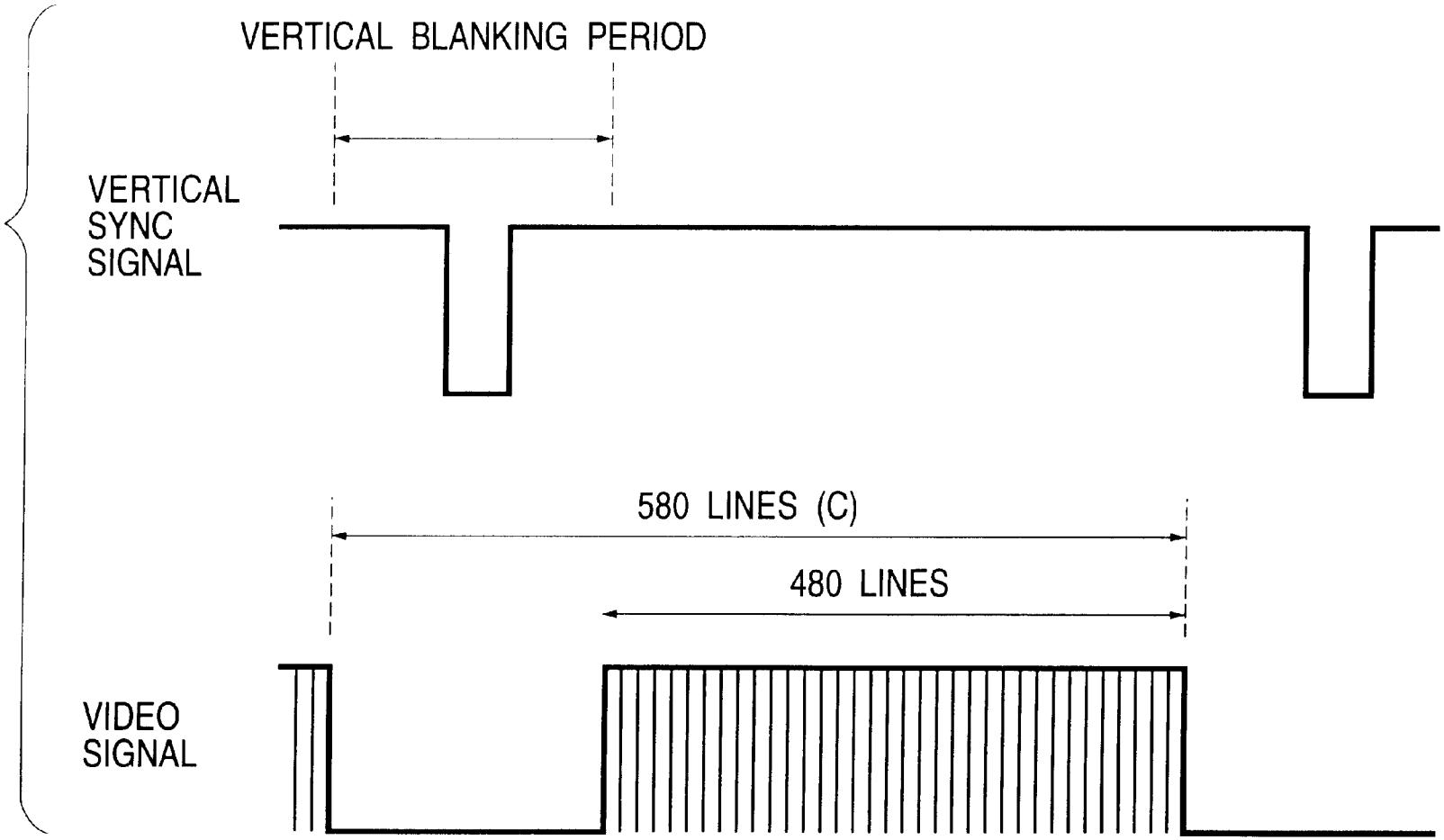
FIG. 8 is a chart for explaining the processing for determining the display mode in the display mode exceptional processing.

In this case, as can be seen from FIG. 8, when the value C is larger than "479" and smaller than "600", the vertical effective image period includes 480 lines, and the vertical blank period is 100.

More specifically, for all the existing display modes having a resolution of 640×480 pixels, the value C is larger than "479" and smaller than "600". Hence, if the value C is "580", it is determined that the vertical resolution is "480".

When the vertical resolution is determined, the horizontal resolution is uniquely determined according to the vertical resolution. This is because there are no display modes having an identical vertical resolution but different horizontal resolutions in this embodiment. Hence, the horizontal resolution is "640" in this case.

As can be seen from the above description, it is consequently discriminated that the display resolution of the input signal in this case is 640×480 pixels (step S405).

Likewise, if the value C satisfies "C<480", it is discriminated that the display resolution of the input signal is 600×400 pixels (step S403). On the other hand, if the value C satisfies "599<C<624", it is discriminated that the display resolution of the input signal is 800×600 pixels (step S407); if "623<C<768", 823×623 pixels (step S409); if "767<C<870", 1,024×768 pixels (step S411); and if "869<C<1,024", 1,152×870 pixels (step S413).

If none of display resolutions are discriminated in steps S402 to S412, i.e., if the value C satisfies "C≧1,024", it is discriminated that the display resolution is 1,280×1,024 pixels (step S413).

In the above-mentioned processing of the first stage, the display resolution of the input signal is discriminated from the display resolution range from 600×400 pixels to 1,280×1,024 pixels. However, the present invention is not limited to such specific range. For example, the display resolution may be discriminated from the range including a display resolution higher than 1,280×1,024 pixels. Alternatively, the display resolution may be discriminated from the range including still higher display resolutions that may be proposed in the future.

After the horizontal and vertical resolutions (display resolution) of the input signal are discriminated by the processing in the first stage, the processing in the second stage (FIG. 7) is executed.

The processing in the second stage determines a display mode classified based on the horizontal and vertical resolutions, horizontal and vertical sync signal frequencies, and polarity of the vertical sync signal, as shown in the table T shown in FIG. 4, on the basis of the display resolution discriminated by the processing in the first stage.

For example, when the display resolution discriminated by the processing in the first stage is 800×600 pixels, one of display modes 09 to Oc in the table T is determined.

The frequency of the input signal, a comparison value MIN, a display mode counter MIN_NUM, and a counter i are respectively initialized to "IN_HD", "100", "0", and "0" (step S415).

It is checked in turn if the counter i is "0" (step S416), if the counter i is "1" (step S418), and if the counter i is "2" (step S420).

If the counter i is "0", the horizontal sync signal frequency (=35.16) of display mode 09 is saved in SP_HD (step S417). On the other hand, if the counter i is "1", the horizontal sync signal frequency (=37.88) of display mode Oa is saved in SP_HD (step S419). Furthermore, if the counter i is "2", the horizontal sync signal frequency (=48.08) of display mode Ob is saved in SP_HD (step S421).

If the counter i is none of "0" to "2", the horizontal sync signal frequency (=46.88) of display mode Oc is saved in SP_HD (step S422).

After the horizontal sync signal frequency in the table T is saved in SP_HD in steps S416 to S422, it is checked if the following condition is satisfied: IN_HD>SP_HD i.e., if the horizontal sync signal frequency (IN_HD) of the input signal is higher than that (SP_HD) of the table T (step S423).

If it is determined in step S423 that "IN_HD>SP_HD", it is then checked if the following condition is satisfied:

$$IN_HD-SP_HD<MIN$$

i.e., if the difference (IN_HD−SP_HD) obtained by subtracting the h orizontal sync signal frequency of the table T from that of the input signal is smaller than the comparison value MIN (step S424).

If it is determined in step S424 that "IN_HD−SP_HD<MIN", the value "IN_HD−SP_HD" is set in the comparison value MIN. Also, the value of the counter i is set in the display mode counter MIN_NUM (step 6426). The flow then advances to step S428.

On the other hand, if it is determined in step S424 that "IN_HD−SP_HD <MIN" does not hold, the flow jumps to step S428.

Also, if it is determined in step S423 that "IN_HD >SP_HD" does not hold, it is checked if the following condition is satisfied:

$$SP_HD-IN_HD<MIN$$

i.e., if the difference (SP_HD−IN_HD) obtained by subtracting the horizontal sync signal frequency of the input signal from that of the table T is smaller than the comparison value MIN (step S425).

If it is determined in step S425 that "SP_HD IN_HD-<MIN", the value "SP_HD-IN_HD" is set in the comparison value MIN. Also, the value of the counter i is set in the display mode counter MIN_NUM (step S426). After that, the flow advances to step S428.

On the other hand, if it is determined in step S425 that "SP_HD-IN_HD<MIN" does not hold, the flow Jumps to step S428.

In step S428, it is checked if the value of the counter i is "3", i.e., if the processing is complete for all the display modes 09 to Oc of the table T.

If it is determined in step S428 that "i≠3", the flow returns to step S416 to repeat the processing from step S416 for the next display mode.

If it is determined in step S428 that "i=3", a sum (MIN_NUM+9) obtained by adding "9" to the value MIN_NUM is determined to be the display mode (step S429), thus ending this processing.

As described above, in the processing in the second stage, the horizontal sync signal frequency of the input signal is compared in turn with those of all the display modes classified in units of resolutions, as shown in the table T in FIG. 4, and a display mode having a horizontal sync signal frequency closest to that of the input signal is determined to be that of the input signal.

In the processing in the second stage, the display mode is determined based on the horizontal sync signal frequency. However, the present invention is not limited to such specific method. For example, the display mode may be determined based on the vertical sync signal frequency.

FIG. 7 above has explained the case wherein it is discriminated in FIG. 6 that the resolution is 800 ×600. Also, when another resolution, i.e., one of 600 ×400, 640×480, 1,024×768, and 1,280×1,024 is discriminated, the display mode can be similarly determined. Furthermore, when it is discriminated in FIG. 6 that the resolution is 832×624 or 1,152×870, the processing in FIG. 7 is not performed, as a matter of course.

As described above, the system control circuit 102 measures the horizontal and vertical sync signal frequencies and the polarity of the vertical sync signal from the horizontal and vertical sync signals and the sync signal polarity signal, and discriminates the display mode of the input video signal on the basis of the measurement results. After that, the system control circuit 102 controls the operations of the above-mentioned clock generation circuit 103, interpolation processing circuit 105, drive control circuit 106 (to be described below), and the like in accordance with the discrimination result, i.e., the determined display mode.

The clock generation circuit 103 comprises a PLL circuit, and the system control circuit 102 changes the center frequency of a VCO or the frequency division ratio of a frequency divider in accordance with the determined display mode, thus changing the frequency of clocks.

The interpolation processing circuit 105 interpolates image data output from the above-mentioned A/D conversion circuit 104 under the control of the system control circuit 102, thus generating image data with a resolution corresponding to the display resolution of the multiscan display unit 107.

More specifically, as the interpolation processing methods popularly used, nearest neighbor interpolation, linear interpolation (first-order interpolation), cubic convolution interpolation, and the like are known.

In nearest neighbor interpolation, the pixel before interpolation nearest the pixel to be interpolated is used as an interpolation pixel.

In linear interpolation, data of the pixel to be interpolated is obtained using data of the pixels on two sides of the pixel to be interpolated.

Figure 9:
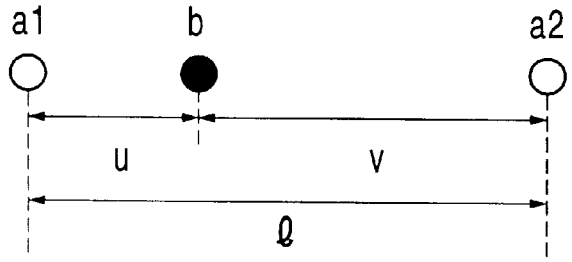
FIG. 9 is a view for explaining linear interpolation.

For example, when pixel b is interpolated at a position (between pixels a1 and a2) distances u and v respectively from two pixels a1 and a2 spaced by a distance l by linear interpolation, as shown in FIG. 9, data of pixel b is obtained by:

$$b=a1*v/(u+v)+a2*u/(u+v) \quad (1)$$

In cubic convolution interpolation, data of the pixel to be interpolated is obtained using data of the two pixels on each of two sides of the pixel to be interpolated and a cubic convolution function.

The cubic convolution function f is given by:

$$f(t)=\sin(\pi t)/(\pi t) \quad (2)$$

where t is the distance between the pixel to be interpolated and two pixels spaced by the distance l on each of two sides of the pixel to be interpolated.

Expansions of Equation (2) are given by:

$$f(t)=1-2*|t|^2+|t|^3(0\leqq|t|<1) \quad (3)$$

$$f(t)=4-8*|t|+5*|t|^2-|t|^3(1\leqq|t|<2) \quad (4)$$

$$f(t)=0(2\leqq|t|) \quad (5)$$

Figure 10:
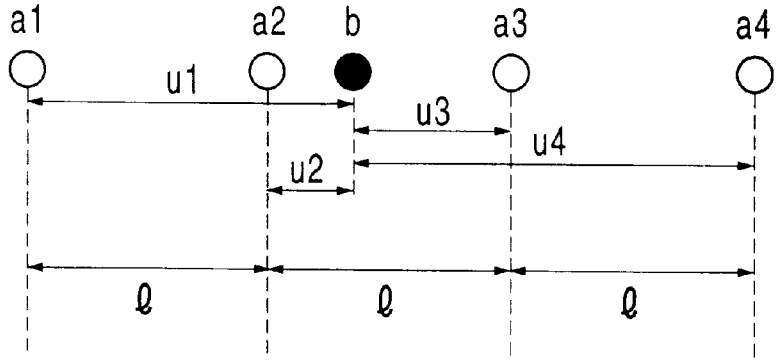
FIG. 10 is a view for explaining cubic convolution interpolation.

For example, when pixel b is interpolated at a position (between pixels a2 and a3) distances u1, u2, u3, and u4 respectively from pixels a1, a2, a3, and a4 spaced by the distance l by the cubic convolution interpolation method, as shown in FIG. 10, data of pixel b is obtained using the above-mentioned cubic convolution function f by:

$$b=a1*(4-8*u1+5u1^2-u1^3+a2*(1-2*u2^2-u2^3)+a3*(1-2*u2^2-u3^3)+a4*(4-8*u4+5*u4^2-u4^3) \quad (6)$$

Figure 11:
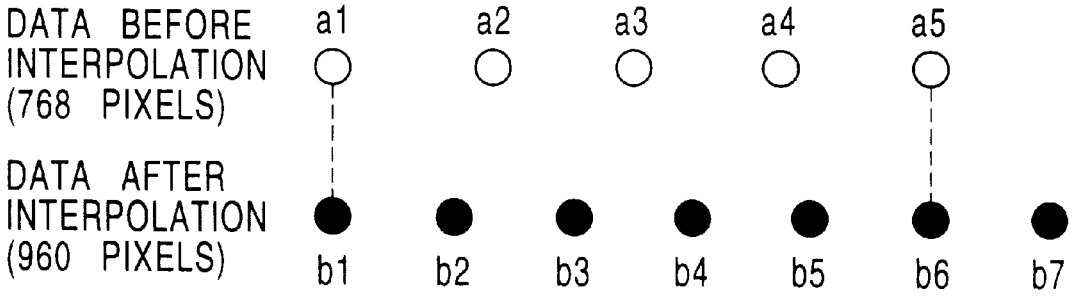
FIG. 11 is a view for explaining linear interpolation and cubic convolution interpolation.

A case will be exemplified below with reference to FIG. 11 wherein interpolation from 768 pixels to 960 pixels by linear interpolation (first-order interpolation) and cubic convolution interpolation given by equations (1) to (6) above.

More specifically, in such case, interpolation data for five pixels are generated from those for four pixels. For this purpose, pixel data bn (n=0, 1, 2, . . . ) after linear interpolation is given, using pixel data an before interpolation, by:

$$b5n+1=a4n+1b5n+2=(1/5)*a4n+1+(4/5)*a4n+2b5n+3=(3/5)*a4n+2+(3/5)*a4n+3$$

$$b5n+4=(3/5)*a4n+3+(2/5)*a4n(n+1)\ b5n+5=(4/5)*a4(n+1)+(1/5)*a4n(n+1)+1 \quad (7)$$

$$b5n+1=a4n+1b5n+2=(-4/125)*a4n+(29/125)*a4n(n+1)+(116/125)*a4n+2+(-16/125)*a4n+3$$

$$b5n+3=(-12/125)*a4n+1+(62/125)*a4n+2+(93/125)*a4n+3+(-18/125*a*4n(n+1)\ b5n+4=(-18/125)*a4n+2+(93/125)*a4n+3$$

$$+(62/125)*a4n(n+1)+(-12/125*a*4n(n+1)+1b5n+5=(-16/125)*a4n+3+(116/125)*a4(n+1)+(29/125)*a4(n+1)+1(-4/125*a*4(n+1)+2 \quad (8)$$

However, when linear interpolation and cubic convolution interpolation given by equations (7) and (8) are to be implemented by hardware (ASIC: Application Specific Integrated Circuit), a plurality of fractions must be calculated, resulting in a non-practical circuit scale.

To avoid this, in this embodiment, since the coefficients in equations (7) and (8) are approximated by sums of exponents of 2, linear interpolation and cubic convolution interpolation can be implemented by small-scale hardware.

That is, approximating equations (7) and (8), we obtain:

$$b5n+1=a4n+1b5n+2=(1/4+1/32)*a4n+1+(1/2+1/4+1/32)*a4n+2$$

$$b5n+3=(1/4+1/8+1/16)*a4n+2+(1/2+1/8+1/32)*a4n+3b5n+4=(1/2+1/8+1/32)*a4n+3$$

$$+(1/4+1/8+1/32)*a4n(n+1)\ b5n+5=(1/2+1/4+1/32)*a4(n+1)+(1/4+1/32)*a4(n+1)+1 \quad (9)$$

$$b5n+1=*a4n+1b5n+2=(-1/32)*a4n+(1/4)*a4n+1$$

$$+(1/2+1/4+1/8+1/16)*a4n+2+(-1/8)*a4n+3\ b5n+3=(-1/8)*a4n+1$$

$$+(1/2)*a4+2+(1/2+1/4)*a4n+3+(-1/8)*a4n+2$$

$$b5n+4=(-1/8)*a4n+2+(1/2+1/4)*a4n+3+(1/2)*a4n(n+1)$$

$$+(-1/8)*a4(n+1)+1b5n+5=(-1/8)*a4n+3+(1/2+1/4+1/8+$$

$$1/16)*a4n+1+(1/4)*a4n(n+1)+1+(-1/32)*a4(n+1)+2 \quad (10)$$

Note that these approximations (9) and (1) are used when the input image data is 6-bit data.

With the above-mentioned approximations respectively from equations (7) and (8) to equations (9) and (10), the number of coefficient terms can be reduced, approximation errors can be minimized, and image data after interpolation assumes a maximum value when the input image data has a maximum value.

Hence, linear interpolation and cubic convolution interpolation can be done by small-scale hardware using equations (9) and (10) above.

Note that equations (9) and (10) above are used when the input image data is 6-bit data. However, the present invention is not limited to this but can cope with input image data of more than 6 bits.

For example, when the input image data is 7- or 8-bit data, image quality can be prevented from deteriorating by adding terms 1/64 or 1/128.

Also, by omitting smaller terms such as 1/32 and the like, the hardware scale can be reduced.

The detailed operation of the interpolation processing circuit shown in FIG. 1 will be explained below.

Figure 12:
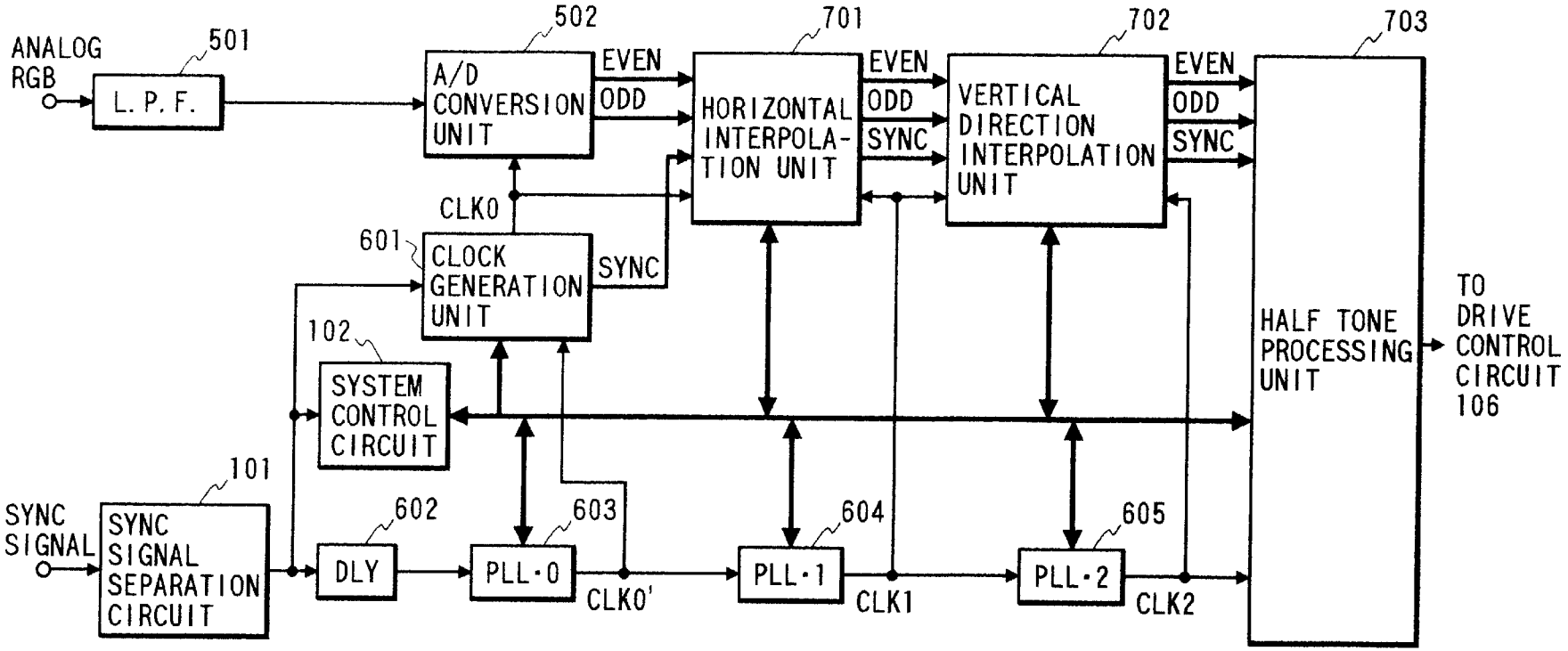
FIG. 12 is a block diagram showing the arrangement of principal part of the device shown in FIG. 1.

FIG. 12 shows the arrangement of principal parts of the device shown in FIG. 1, and the same reference numerals in FIG. 12 denote the same parts as in FIG. 1.

In FIG. 12, an LPF 501 limits the frequency band of an analog RBG signal supplied from the sync signal separation circuit 101. An A/D conversion unit 502 samples the video signal band-limited by the LPF 501 in accordance with clocks CLKO supplied from a clock generation unit 601, and converts it into a digital signal. These LPF 501 and A/D conversion unit 502 form the A/D conversion circuit 104.

The clock generation unit 601 generates the clocks CLK0 synchronous with the sync signal supplied from the sync signal separation circuit 101. A delay circuit 602 delays the sync signal supplied from the sync signal separation circuit 101 to adjust its phase. A PLL-0 603 generates clocks CLK0' synchronous with the sync signal output from the delay circuit 602. A PLL-1 604 generates clocks CLK1 obtained by multiplying CLK0' by a given coefficient, and a PLL-2 generates clocks CLK2 obtained by multiplying CLK1 by a given coefficient. These clock generation unit 601, delay circuit 602, and PLLs 603, 604, and 605 constitute the clock generation circuit 103.

A horizontal interpolation unit 701 expands the image signal in the horizontal direction. A vertical interpolation unit 702 expands the image signal in the vertical direction. A halftone processing unit 703 performs image processing of the interpolated image signal. These horizontal interpolation unit 701, vertical interpolation unit 702, and halftone processing unit 703 build the interpolation processing circuit 105.

The operation will be explained below.

As described above, the system control circuit 102 discriminates the display mode on the basis of the state of the sync signal of the input image signal. The system control circuit 102 controls the clock generation unit 601 and PLLs 603 to 605 and also controls the horizontal and vertical interpolation units 701 and 702 and halftone processing unit 703, in accordance with the discrimination result.

The delay circuit 602 adjusts the phase shift between the image signal and sync signal, which were in phase with each other when they were output from the host computer, but have a phase shift after they have been processed via different processing systems.

The digital image signal obtained by the A/D conversion unit 501 is enlarged by interpolation by the horizontal and vertical interpolation units 701 and 702 in accordance with the magnification determined by the system control circuit 102.

The operation of the horizontal interpolation unit 701 will be explained below with reference to FIG. 13.

Figure 13:
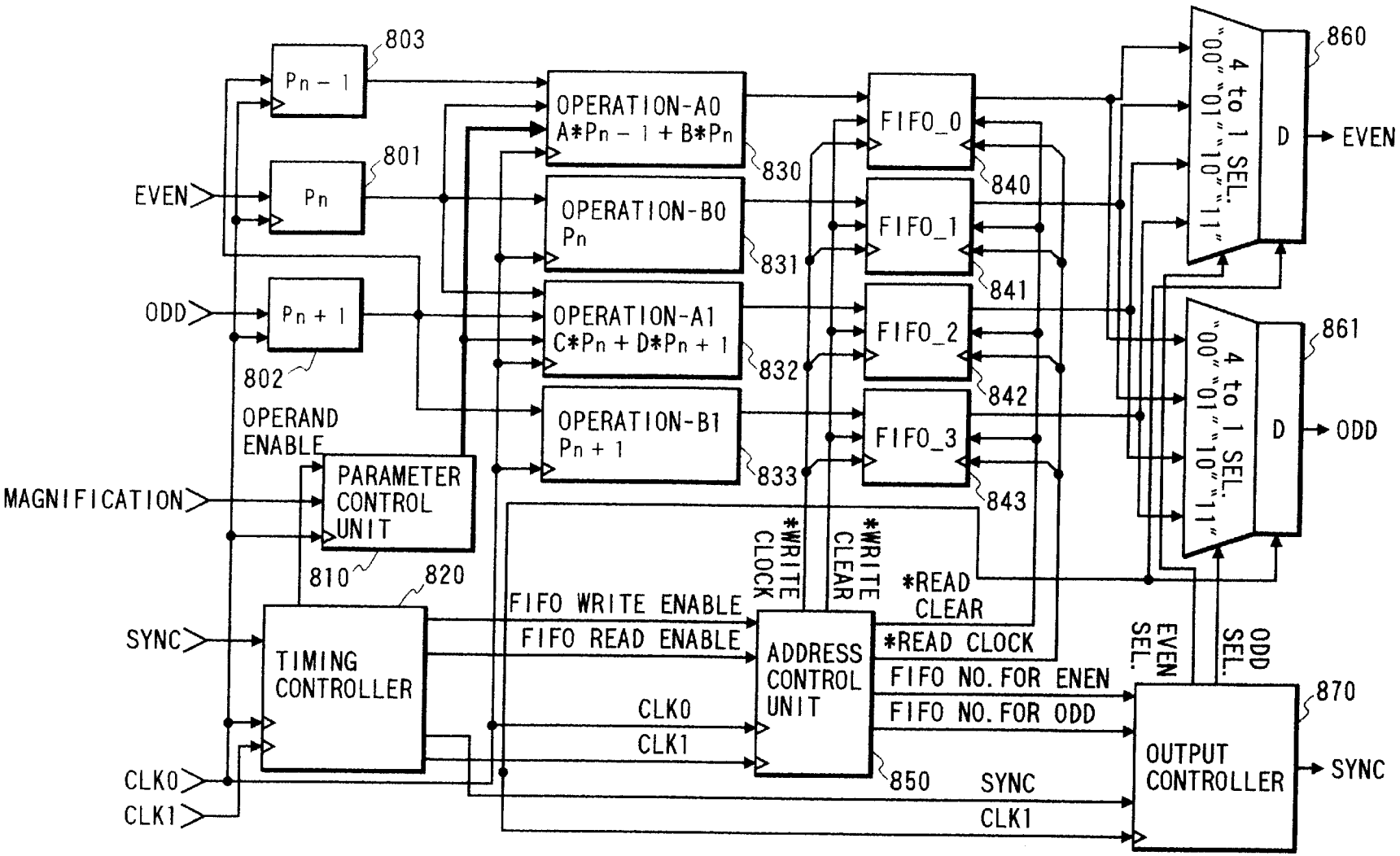
FIG. 13 is a block diagram showing the arrangement of a horizontal interpolation unit shown in FIG. 12.

FIG. 13 shows the arrangement of the horizontal interpolation unit 701. In FIG. 13, the unit 701 comprises latch units 801 to 803 for latching input data, a parameter control unit 810 for controlling parameters for interpolation operations, a timing controller 820 for controlling the timings of the individual modules in the overall unit, operation units 830 to 833 for performing interpolation operations, FIFOs 840 to 843 for storing interpolation operation results, an address control unit 850 for controlling reads, writes, and the like of the FIFOs, output selection units 860 and 861 for selecting the data to be output, and an output controller 870 for generating sync signals.

The input interlaced image signal is latched by the latch units 801 and 802 in units of Odd and Even fields, and the latch unit 803 latches image data for the immediately preceding Odd field. These image data are input to the operation units 830 to 833 on the basis of the operators set by the parameter control unit 810, as shown in FIG. 13.

Figure 14:
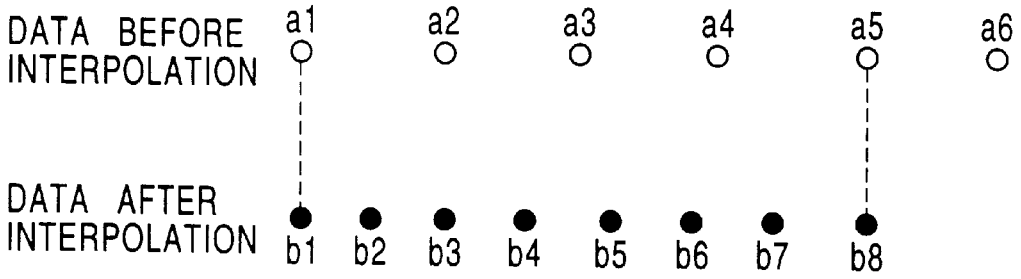
FIG. 14 is a view for explaining the operation of FIG. 13.

An example of operations used in this embodiment is as follows. In the following example, interpolation from VGA data to XGA data is done at an interpolation magnification of (8/5)×. As shown in FIG. 14, a1, a2, . . . , an indicate the input pixels, and b1, b2, . . . , bn indicate the output pixels.

$$b1=a1$$

$$b2=(1/4+1/8)*a1+(1/2+1/8+1/16)*a2$$

$$b3=a2$$

$$b4=a3$$

$$b5=(1/2+1/32)*a3+(1/2)*a4$$

$$b6=a4$$

$$b7=a5$$

$$b8=(1/2+1/8+1/16)*a5+(1/4+1/8)*a6$$

The parameter control unit 810 determines the respective parameters to attain the above operations on the basis of a signal indicating the magnification supplied from the system control circuit 102, and sends them to the operation units 830 and 833 from the timing controller 820 at timings according to the sync signal and clocks CLK0 and CLK1. The operated image data are temporarily stored in the FIFO-0 (840), FIFO-1 (841), FIFO-2 (842), and FIFO-3 (843), and are then supplied to the output selection units 860 and 861.

On the other hand, the input sync signal is supplied to the timing controller 820, which sends control signals to the respective modules to adjust the number of stages in the peripheral pipeline process, and to control asynchronous modules. Upon reception of an enable signal from the timing controller 820, the address control unit 850 controls data read/write addresses for the FIFO-0 (840), FIFO-1 (841), FIFO-2 (842), and FIFO-3 (843). The output controller 870 adjusts the timings of the sync signal and control signals of the output selection units 860 and 861. The clocks CLK1 are obtained by multiplying CLKO by (8/5) in the PLL-1 (604), and are used as read clocks for the FIFOs.

Figure 15:
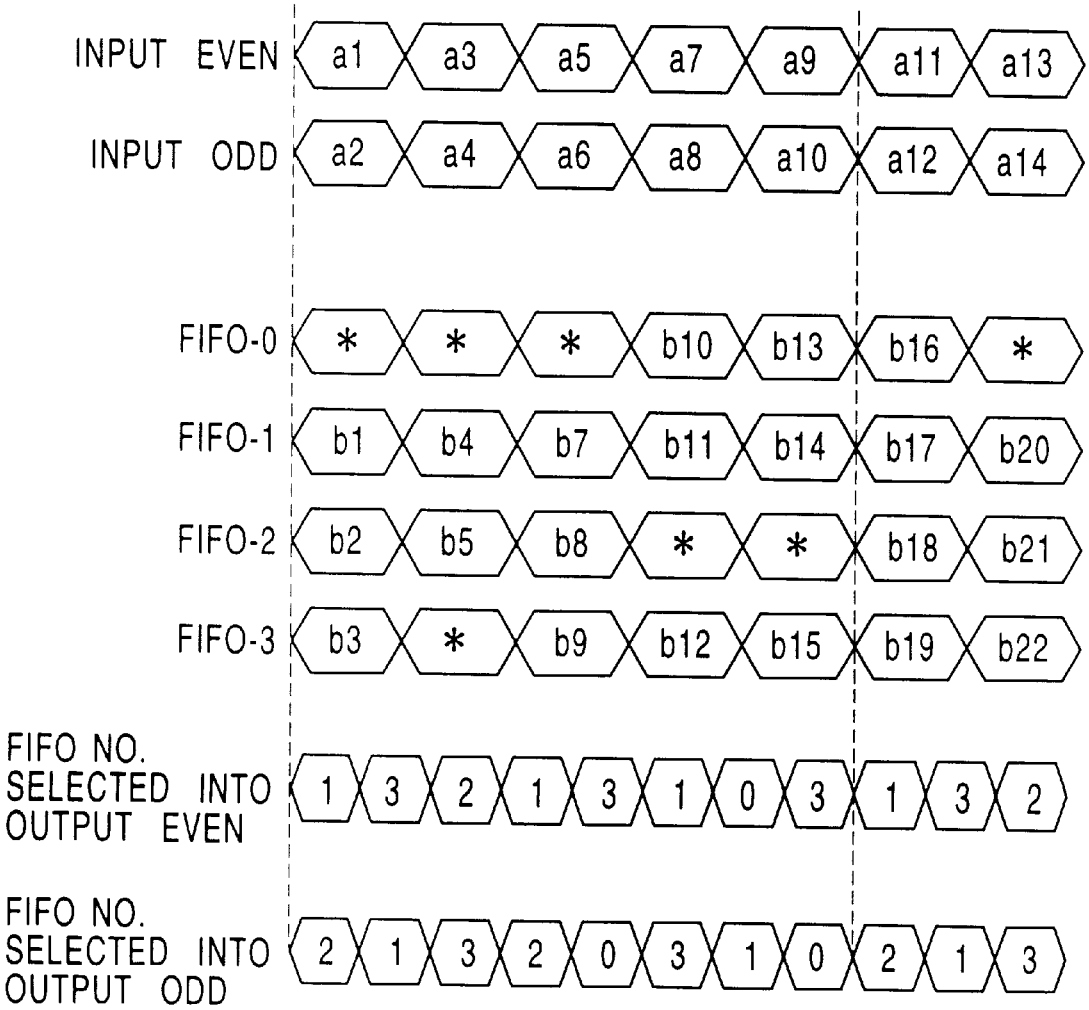
FIG. 15 is a chart showing the states of data of the respective units shown in FIG. 13.

FIG. 15 shows the states of data in the respective modules of the horizontal interpolation unit 701. In FIG. 15, a1, a2, . . . , an indicate the input pixels, and the FIFO-0 (840), FIFO-1 (841), FIFO-2 (842), and FIFO-3 (843) respectively store operated output pixels b1, b2, . . . , bn in response to CLK0. Then, the horizontally interpolated data are read out in response to the multiplied clocks CLK1, and new, horizontally interpolated data can be obtained from the output selection units 860 and 861 by passing the numbers of the FIFOs to be selected to the output selection units 860 and 861.

The vertical interpolation unit 702 enlarges data by interpolation in accordance with a magnification instruction from the system control circuit 102 using known line interpolation. The halftone processing unit 703 receives the interpolated image signal, CLK2, and signals from the system control circuit 102, and performs digital image processing suitable for display. After the halftone processing, the digital video data is transferred to the drive control circuit 106.

Note that a memory comprising the FIFOs 840 to 843 can have a minimum required memory capacity of (1+1) pixels in the horizontal direction×(1+1) lines in the vertical direction assuming that a minimum integer equal to or larger than the quotient of max(n, m)/min(n, m) is 1 upon executing resolution conversion of n/m.

In this way, according to the interpolation processing circuit of this embodiment, an image such as a high-quality computer image or the like, which is enlarged by interpolation and is free from flickering, can be obtained. Since asynchronous reads and writes of the memory are made in real time, resolution conversion can be attained with low cost using a small-capacity memory without requiring any large-capacity memory such as a frame buffer, line buffer, or the like.

After interpolation by the interpolation processing circuit 105, as described above, the image data obtained is supplied to the drive control circuit 106.

The drive control circuit 106 converts the image data supplied from the interpolation processing circuit 105 into data that can be output to the dot matrix display unit 107 under the control of the system control circuit 102, and controls driving of the dot matrix display unit 107.

With the above control, the dot matrix display unit 107 makes a screen display according to the data output from the drive control circuit 106.

As described above, in this embodiment, when a combination of the horizontal vertical sync signal frequencies and the polarity of the vertical sync signal obtained from the input video signal are not assumed in advance as a compatible display mode, a display mode, which has a frequency closest to the horizontal or vertical sync signal frequency of the input signal among those having the same display resolution as that obtained from the horizontal and vertical sync signal frequencies of the input video signal in the assumed display modes, is determined as that of the input video signal. In this manner, the conventional problems posed when the display mode of the input video signal is not determined can be prevented, i.e., states wherein no image is displayed, a small image is displayed at the center of the screen, or an image is not normally displayed, and so on, can be avoided. Therefore, the display control device can cope with every display mode as well as a display mode which is not assumed in advance as a compatible display mode.

When linear interpolation and cubic convolution interpolation are done for the input image signal, the coefficients in equations (7) and (8) above are approximated by sums of exponents of 2 like in equations (9) and (10). With such approximations, linear interpolation and cubic convolution interpolation can be implemented using small-scale hardware, thus achieving efficient interpolation. Hence, the overall device size can be reduced, and processing performance can be improved.

The above embodiment has exemplified the display control device 100 for the dot matrix display unit 107 having the multiscan function. The embodiment to be described below will exemplify a display control device for a CRT display unit having a multiscan function.

Figure 16:
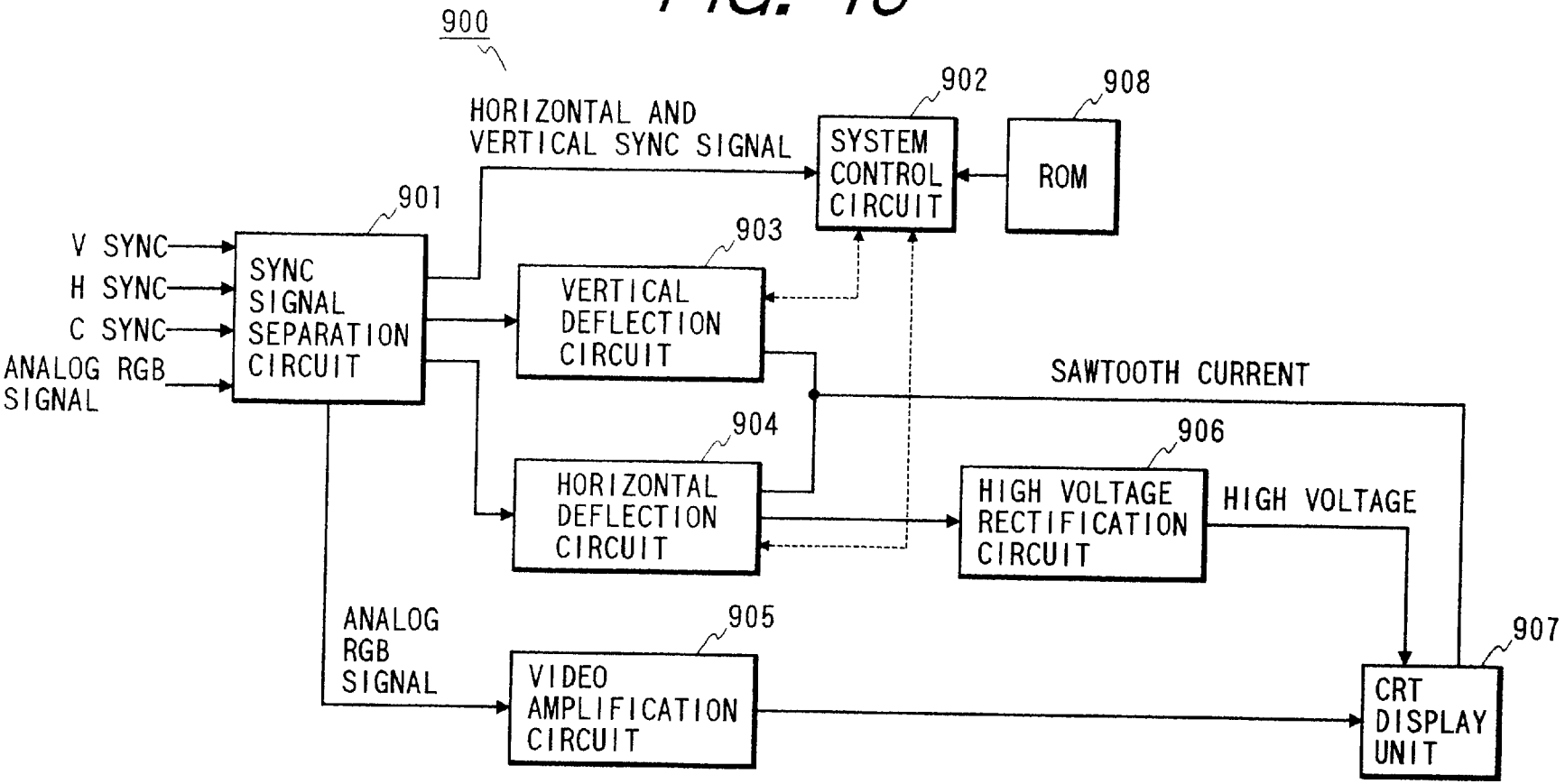
FIG. 16 is a block diagram showing the arrangement of a display control device according to another embodiment of the present invention.

More specifically, the display control device according to the present invention is applied to, e.g., a display control device 900 shown in FIG. 16.

As shown in FIG. 16, the display control device 900 comprises a sync signal separation circuit 901 which receives signals from a host computer apparatus (not shown), a system control circuit 902, vertical deflection circuit 903, horizontal deflection circuit 904, and video amplification circuit 905, which receive the outputs from the sync signal separation circuit 901, a high voltage rectification circuit 906 which receives the output from the horizontal deflection circuit 904, and a ROM 908 accessed by the system control circuit 902. The outputs from the vertical deflection circuit 903, horizontal deflection circuit 904, video amplification circuit 905, and high voltage rectification circuit 906 are supplied to a CRT display unit 907.

As in the above embodiment, the display control device 900 receives a video signal supplied from the host computer apparatus. The video signal includes an RGB signal (image signal) and sync signals such as composite sync, separate sync, sync-on-green, or the like.

The sync signal separation circuit 901 separates an image signal and sync signal from the input video signal as in the sync signal separation circuit 101 in FIG. 1. The sync signal separation circuit 901 generates negative horizontal and vertical sync signals, and sync signal polarity signal from the separated sync signal, and supplies them to the system control circuit 902, vertical deflection circuit 903, and horizontal deflection circuit 904. Also, the circuit 901 supplies the separated image signal to the video amplification circuit 905.

The system control circuit 902 reads out and executes a processing program pre-stored in the ROM 908 as in the system control circuit 102 shown in FIG. 1, thereby measuring the horizontal and vertical sync signal frequencies and the polarity of the vertical sync signal from the horizontal and vertical sync signals and sync signal polarity signal supplied from the sync signal separation circuit 901. The circuit 902 discriminates the display mode of the input video signal based on the measurement result, and controls the vertical and horizontal deflection circuits 903 and 904 on the basis of the discrimination outcome.

As in the above embodiment, the ROM 908 pre-stores the processing programs shown in FIG. 2 and FIGS. 5 to 7, and when these processing programs are read out and executed by the system control circuit 902, display mode discrimination, display mode discrimination exceptional processing executed when a signal which is not assumed as a compatible display mode is input, and the like are done. Since the display mode discrimination, display mode discrimination exceptional processing, and the like executed by the system control circuit 902 are the same as those done by the system control circuit 102 in FIG. 1, a detailed description thereof will be omitted.

The vertical and horizontal deflection circuits 903 and 904 generate sawtooth wave signals for deflecting electron beams of the CRT display unit 907 to the CRT display unit 907.

At this time, the system control circuit 902 controls the vertical and horizontal deflection circuits 903 and 904 in accordance with the display mode (display resolution) determined as described above.

As the electron beam deflection method, electromagnetic and electrostatic deflection methods are known. In the electromagnetic deflection method, a current is supplied to a deflection coil to generate a magnetic field, which deflects electron beams, and this method is popularly used in raster-scan displays. On the other hand, in the electrostatic deflection method, a voltage is applied across two opposing deflection plates, and electron beams are moved by an electric field. This method is normally used in random-scan displays.

The high voltage rectification circuit 906 obtains a high voltage required for the node and focus electrode of the CRT display unit 907 by rectifying high-voltage pulses produced in the horizontal blanking period using a flyback transformer, in accordance with the output from the horizontal deflection circuit 904.

The video amplification circuit 905 amplifies the image signal supplied from the sync signal separation circuit 901 and supplies it to the CRT display unit 907.

Hence, the CRT display 907 displays the image signal supplied from the video amplification circuit 905 on its screen in accordance with the sawtooth wave signals generated by the vertical and horizontal deflection circuits 903 and 904, and high-voltage pulses generated by the high voltage rectification circuit 906.

With the above-mentioned control, even when the object to be controlled is the CRT display unit 907, the display control device can cope with every display modes as well as a display mode which is not assumed in advance as a compatible display mode as in the above-mentioned embodiment.

Note that the present invention may be applied to either the data processing method in an apparatus consisting of a single device as shown in FIG. 1 or 16, or a system constituted by a plurality of devices.

Also, the objects of the present invention are achieved by supplying a storage medium (corresponding to the ROM 108 in FIG. 1 or ROM 908 in FIG. 16) that stores a program code of software which implements the functions of a host and terminal of the above-mentioned embodiments to the system or apparatus, and reading out and executing the program code stored in the storage medium by a computer (or a CPU or MPU) of the system or apparatus.

In this case, the program code itself read out from the storage medium realizes the functions of the above embodiments, and the storage medium that stores the program code constitutes the present invention.

The storage medium for supplying the program code is not limited to the above-mentioned ROM 108 or 908, and for example, a floppy disk, hard disk, optical disk, magneto-optical disk, CD-ROM, CD-R, magnetic tape, nonvolatile memory card, and the like may be used instead.

The functions of the above embodiments are realized not only by executing the readout program code by the computer but also by some or all of actual processing operations executed by an OS or the like running on the computer on the basis of an instruction of the program code.

Furthermore, the functions of the above-mentioned embodiments may be realized by some or all of actual processing operations executed by a CPU or the like arranged in a function extension board or a function extension unit, which is inserted in or connected to the computer, after the program code read out from the storage medium is written in a memory of the extension board or unit.

Many widely different embodiments of the present invention may be constructed without departing from the spirit and scope of the present invention. It should be understood that the present invention is not limited to the specific embodiments described in the specification, except as defined in the appended claims.

What is claimed is:

1. A display control device for controlling a display device which displays an image corresponding to an input video signal, with the display device displaying the image in a plurality of n predetermined display modes, said device comprising:

detection means for detecting a state of the input video signal;

mode setting means for setting a display mode of the display device matching the detected state of the input video signal among the n predetermined display modes on the basis of an output of said detection means, said mode setting means setting the display mode of the display device to one of the n predetermined display modes when the state of the input video signal detected by said detection means does not match any of the n predetermined display modes; and control means for controlling display operation of the display device in accordance with the display mode set by said mode setting means.

2. A device according to claim 1, wherein said detection means detects a state of a sync signal in the video signal, and wherein said mode setting means sets the display mode on the basis of the state of the sync signal detected by said detection means.

3. A device according to claim 2, wherein said detection means detects a frequency of a sync signal in the video signal, and wherein said mode setting means sets the display mode on the basis of the frequency of the sync signal detected by said detection means.

4. A device according to claim 2, wherein said detection means detects a polarity of a sync signal in the video signal, and wherein said mode setting means sets the display mode on the basis of the polarity of the sync signal detected by said detection means.

5. A device according to claim 1, wherein said detection means detects resolution of the video signal, and wherein when the state of the input video signal detected by said detection means does not match any of the n predetermined display modes, said mode setting means determines the display mode among the n different display modes on the basis of the resolution detected by said detection means.

6. A device according to claim 1, wherein the n predetermined display modes have different resolutions, and vertical and horizontal sync frequencies.

7. A device according to claim 1, wherein said mode setting means has a memory which stores the states of the video signal corresponding to the n predetermined display modes.

8. A device according to claim 1, wherein said control means has clock generation means for generating a clock in phase with the input video signal, and controls the generation operation of said clock generation means in accordance with the display mode set by said mode setting means.

9. A device according to claim 1, wherein said control means has interpolation means for performing interpolation of the input video signal, and controls the interpolation in accordance with the display mode set by said mode setting means.

10. A device according to claim 9, wherein said control means further has clock generation means for generating a first clock in phase with the input video signal, and a second clock having a frequency corresponding to the display mode set by said mode setting means using the first clock, and wherein said interpolation means has resolution conversion means for converting resolution of the input video signal in accordance with the display mode set by said mode setting means, a memory for storing the resolution-converted video signal, and memory control means for writing the video signal in said memory in accordance with the first clock, and reading out the video signal from said memory in accordance with the second clock.

11. A device according to claim 1, wherein said display device includes a dot matrix type display device.

12. A device according to claim 1, wherein said display device includes a CRT.

13. A storage medium which computer-readably stores a display control processing step for a display device for displaying an image corresponding to an input video signal, with the display device displaying the image in a plurality of n predetermined display modes, wherein the display control processing step includes:

a detection step of detecting a state of the input video signal;

a mode setting step of setting a display mode of the display device matching the detected state of the input video signal among n predetermined display modes on the basis of an output of the detection step; and a control step of controlling display operation of the display device in accordance with the display mode set in the mode setting step, wherein the mode setting step includes the step of setting the display mode of the display device to one of the n predetermined display modes when the state of the input video signal detected in the detection step does not match any of the n predetermined display modes.

14. A medium according to claim 13, wherein the detection step includes a step of detecting a state of a sync signal in the video signal, and wherein the mode setting step includes a step of setting the display mode on the basis of the state of the sync signal detected in the detection step.

15. A medium according to claim 13, wherein the detection step includes a step of detecting a frequency of a sync signal in the video signal, and wherein the mode setting step includes a step of setting the display mode on the basis of the frequency of the sync signal detected in the detection step.

16. A medium according to claim 13, wherein the detection step includes a step of detecting a polarity of a sync signal in the video signal, and wherein the mode setting step includes a step of setting the display mode on the basis of the polarity of the sync signal detected in the detection step.

17. A medium according to claim 13, wherein the detection step includes a step of detecting resolution of the video signal, and wherein the mode setting step includes a step of determining the display mode among the n predetermined display modes on the basis of the resolution detected in the detection step when the state of the input video signal detected in the detection step does not match any of the n predetermined display modes.

18. A medium according to claim 13, wherein the n predetermined display modes have different resolutions, and vertical and horizontal sync frequencies.

19. A medium according to claim 13, wherein the states of the video signal corresponding to the n predetermined display modes are stored.

20. A medium according to claim 13, wherein the control step includes a clock generation step of generating a clock in phase with the input video signal, and includes a step of controlling the generation operation in the clock generation step in accordance with the display mode set in the mode setting step.

21. A medium according to claim 13, wherein the control step includes a interpolation step of performing interpolation of the input video signal, and includes a step of controlling the interpolation in accordance with the display mode set in the mode setting step.

22. A method of controlling a display processing of a display device for displaying an image corresponding to an input video signal, with the display device displaying the image in a plurality of n predetermined display modes, comprising:

a detection step of detecting a state of the input video signal;

a mode setting step of setting a display mode of the display device matching the detecting state of the input video signal among the n predetermined display modes on the basis of an output of the detection step; and a control step of controlling display operation of the display device in accordance with the display mode set in the mode setting step, wherein the mode setting step includes the step of setting the display mode of the display device to one of the n predetermined display modes when the state of the input video signal detected in the detection step does not match any of the n predetermined display modes.

23. A method according to claim 22, wherein the detection step includes a step of detecting a state of a sync signal in the video signal, and wherein the mode setting step includes a step of setting the display mode on the basis of the state of the sync signal detected in the detection step.

24. A method according to claim 22, wherein the detection step includes a step of detecting a frequency of a sync signal in the video signal, and wherein the mode setting step includes a step of setting the display mode on the basis of the frequency of the sync signal detected in the detection step.

25. A method according to claim 22, wherein the detection step includes a step of detecting a polarity of a sync signal in the video signal, and wherein the mode setting step includes a step of setting the display mode on the basis of the polarity of the sync signal detected in the detection step.

26. A method according to claim 22, wherein the detection step includes a step of detecting resolution of the video signal, and wherein the mode setting step includes a step of determining the display mode among the n predetermined display modes on the basis of the resolution detected in the detection step when the state of the input video signal detected in the detection step does not match any of the n predetermined display modes.

27. A method according to claim 22, wherein the n predetermined display modes have different resolutions, and vertical and horizontal sync frequencies.

28. A method according to claim 22, wherein the states of the video signal corresponding to the n predetermined display modes are stored.

29. A method according to claim 22, wherein the control step includes a clock generation step of generating a clock in phase with the input video signal, and includes a step of controlling the generation operation in the clock generation step in accordance with the display mode set in the mode setting step.

30. A method according to claim 22, wherein the control step includes an interpolation step of performing interpolation of the input video signal, and includes a step of controlling the interpolation in accordance with the display mode set in the mode setting step.

* * * * *

UNITED STATES PATENT AND TRADEMARK OFFICE

CERTIFICATE OF CORRECTION

PATENT NO. : 6,348,931 B1
DATED : February 19, 2002
INVENTOR(S) : Kazumi Suga et al.

It is certified that error appears in the above-identified patent and that said Letters Patent is hereby corrected as shown below:

Drawings,
Sheet 3, FIG. 3, "PLUSES" should read -- PULSES --.
Sheet 7, FIG. 7, "FREQOENCY" should read -- FREQUENCY --.

Column 2,
Line 50, "unwontedly" should read -- unwantedly --.

Column 5,
Line 7, "(step 8203)." should read -- (step S203). --.

Column 8,
Line 53, "(step 6426)." should read -- (step S426). --.

Column 10,
Line 37, "5ul^2" should read -- 5*ul^2 --.
Line 58, "$-{}^{12}/_{125}$*a*4n(n+1)" should read -- $-{}^{12}/_{125}$*a4(n+1) --.

Column 11,
Line 15, "*a4n+2" should read -- *a4(n+1) --.
Line 16, "*a4n(n+1)" should read -- *a4(n+1) --.
Line 18, "*a4n+1" should read -- *a4(n+1) --.

Signed and Sealed this

Thirteenth Day of May, 2003

JAMES E. ROGAN
*Director of the United States Patent and Trademark Office*